United States Patent [19]

Fremont

[11] 3,980,368

[45] Sept. 14, 1976

[54] ADAPTER FOR POWER DISTRIBUTION SYSTEM

[75] Inventor: Robert S. Fremont, Glencoe, Ill.

[73] Assignee: McGraw-Edison Company, Elgin, Ill.

[22] Filed: Apr. 23, 1975

[21] Appl. No.: 570,596

[52] U.S. Cl. ..... 339/21 R; 339/32 M; 339/88 R

[51] Int. Cl.[2] ..... H01R 9/00

[58] Field of Search ..... 339/20–24, 339/31 R, 31 M, 32 R, 32 M, 33, 88 R, 88 C, DIG. 2

[56] References Cited

UNITED STATES PATENTS

| | | | |
|---|---|---|---|
| 3,718,816 | 2/1973 | Seelbach | 339/22 B |
| 3,832,503 | 8/1974 | Crane | 339/21 R |
| 3,848,715 | 11/1974 | Hesse | 339/21 R |

*Primary Examiner*—Roy Lake
*Assistant Examiner*—Mark S. Bicks
*Attorney, Agent, or Firm*—Max R. Kraus

[57] ABSTRACT

This invention relates to an adapter for use with a multi-circuit channel shaped electric power distribution system along any region thereof to tap power from any power circuit for application to a single circuit load. The adapter includes means for selecting a desired circuit as a live source of power for the load and for indicating the identity of the selected power circuit. The adapter also includes easily available means for effecting switching changes to select a desired power circuit for energizing a load.

5 Claims, 10 Drawing Figures

CIR. 1
CIR. 2
CIR. 3
CIR. 4
23a
22a
21a
23b
22b
21b
40
41
42
43
36
36a
36b
40c
41c
42c
43c
37
37a
37b
37f
45
46
47
48
A
D
L
Al

ADAPTER FOR POWER DISTRIBUTION SYSTEM

BACKGROUND OF THE INVENTION

The invention disclosed herein is an improvement upon the inventions disclosed in prior U.S. Pat. Nos. 3,649,741, issued Mar. 14, 1972, and 3,611,252, issued Oct. 5, 1971. In these patents, a power distribution system is disclosed wherein a U-shaped track carries within the track region elongated molded insulation and bare copper conductors to provide an assembly along which a load circuit power take-off may be established at any desired region along the track length. While the constructions disclosed in these patents have been successful, it has been found desirable to increase the functional possibilities of the track system and provide an adapter for selecting a load circuit from as many as four available power circuits and to indicate such selection.

THE TRACK ASSEMBLY

The track assembly consists of the track body, electrically insulating liners and conductors. The track body is most conveniently an extrusion of metal or plastic having sufficient strength to be self supporting. The track body may come in lengths of 4 feet or longer. A track may be of extruded aluminum having a suitable thickness. A track, as seen in section, has sides 10 and 11 lying in spaced parallel planes. Track side 10 has upper portion 10*a* and lower portion 10*b*, slightly offset outwardly from intermediate portion 10*c*. This offset arrangement reduces the area of contact between adjacent track lengths when in storage, permitting a track length to be pulled out with minimum effort and also minimizing scratching or otherwise damaging the outer surface of one track when moved relatively to the outer surface of an adjacent track. The amount of offset between the two outer portions 10*a* and 10*b* on the one hand, and 10*c* on the other hand, may be quite small, as about 1/64th of an inch. The top ends of track portion 10*a* terminate in flanges 10*d*, the opposing flanges extending toward each other.

Figure 1:
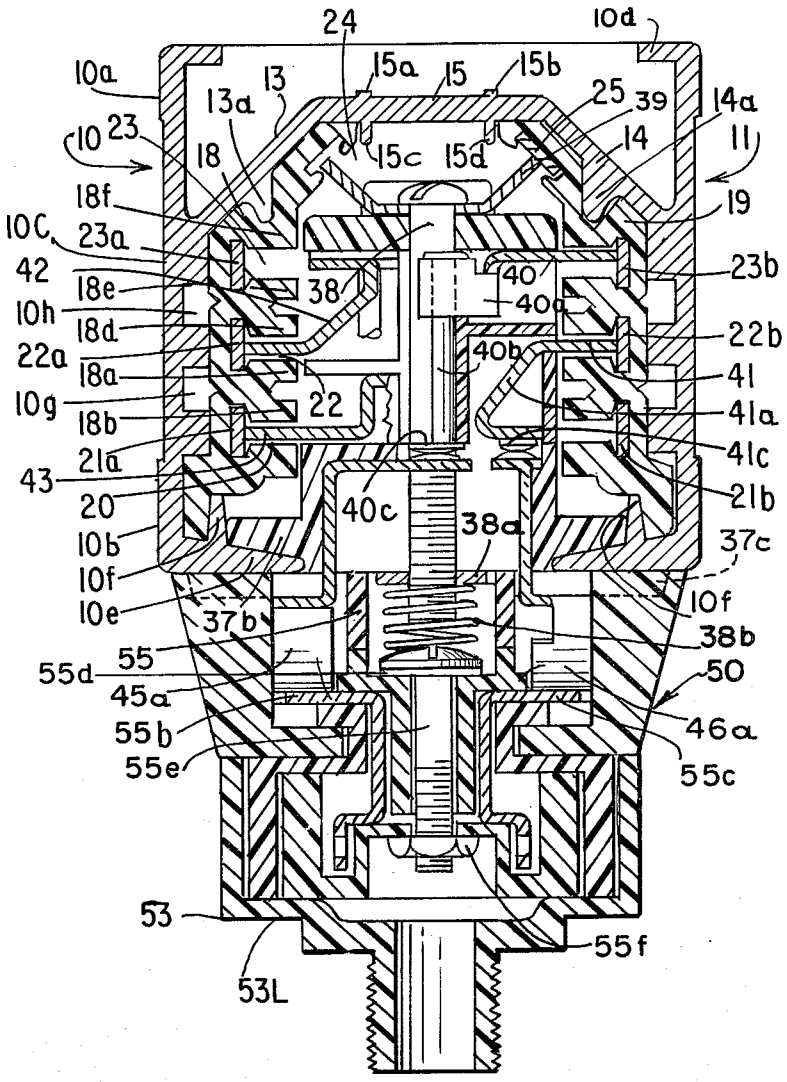
FIG. 1 is a transverse sectional view on an enlarged scale of a track assembly having the new adapter in position within the track for providing a single circuit load from available circuits within the track assembly, here shown as four power circuits and a load plug for connection to the adapter.

The bottom edges of sides 10*b* each terminate in a pair of tapering flanges 10*e* and 10*f* at right angles to each other. Flange 10*e* is a locking flange while flange 10*f* functions in a guiding capacity and also has some locking function. In a practical construction, each side 10 may be in the order of about 1¾ inches between the top and bottom flanges, this dimension being an outside dimension. Longitudinally of a track along the inside surface of side 10, there may be a nunmber of channels 10*g* and 10*h*, such channels being rectangular in section, although the shape and the number of such channels is not important. At a region somewhat below top flange 10*b*, and extending laterally toward the opposing side is an arch construction which may have any desired shape but is most conveniently in the shape of a semi-hexagonal arch having sides 13 and 14 extending upwardly as seen in FIG. 1, leading to arch top 15. Arch top 15 is spaced somewhat below the inside plane defined by the surfaces of inwardly extending top flanges 10*d*. Arch sides 13 and 14 are each provided with downwardly extending guide ribs 13*a* and 14*a*. Similarly, arch portion 15 is provided with ribs extending longitudinally of the track, ribs 15*a* and 15*b* extending outwardly from the outer surface of arch portion 15 and ribs 15*c* and 15*d* extending inwardly of the arch portion 15.

A track length is adapted to be mounted in the position shown in FIG. 1, the mounting being from supports, either along a ceiling surface, or beams or other supports. As an example, a support plate (not shown) may be disposed between the sides of a track just below flanges 10*d* (in which case the track would have to be moved longitudinally into position) or by drilling holes through arch portion 15 between flanges or guide ribs 15*a* and 15*b*. The track portions may be strong enough so that it is unnecessary to have continuous support along the length of a track and instead support means at spaced intervals may be provided.

A track assembly includes insulating liners 18 and 19. The two liners are disposed in the track body against the inner side surfaces thereof and are adapted to be retained in position by virtue of the interlocking action of the opposing track and liner shapes. The liners are preferably molded of electrically insulating material and mechanically reasonably strong enough in thicknesses of about ⅛th inch to retain their shape and retain electrical conductors to be described. The bottom edge portion of a liner is shaped to conform to the inner surfaces of the bottom portion of the side portion 10*b* and flange 10*f* for locking in position. Each liner is preferably stiff enough so that it may be inserted into position by longitudinally sliding the liner into the track body. The portion of a liner within the side portion 10 of a track is shaped to provide guide and support portions 18*a* to 18*f*, inclusive. Support portions 18*a* and 18*b* are separated by space 20 which is enlarged to provide an enlarged reentrant channel 21. Reentrant channels 22 and 23 are similarly provided between support portions 18*d* and 18*e* on the one hand and 18*f* on the other hand.

The reentrant channels are shaped to accommodate flat strip metal conductors 21*a*, 22*a* and 23*a*, and 21*b*, 22*b* and 23*b*. The conductors forming part of the track assembly are of copper.

The upper portions of liners 18 and 19 are shaped to interlock and be guided by ribs 13*a* of arch portions 13 and 14 and are each provided with reentrant channels to accommodate a flat strip conductor 25. This conductor is used for grounding and may be disposed in either of these channels, depending on wiring.

The Adapter

Figure 3:
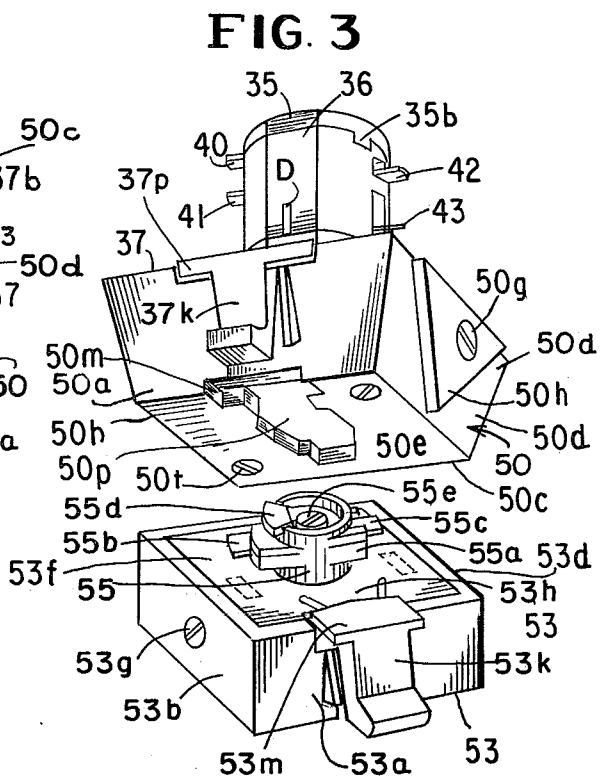
FIG. 3 are perspectives of the adapter and load plug.

The adapter comprises an assembly which may be mounted in a track assembly or removed therefrom at any time. A load plug connector is shown in FIGS. 1 and 3 and is adapted to be connected into or removed from the adapter proper. The adapter proper in assembled form includes a molded turret cap 35 whose outer face carries a pair of integral, parallel spaced projecting guide portions 35*a*. Cap 35 carries at its periphery lateral locking fingers 35*b* on diametrically opposite sides of cap 35 extending from one face of the cap, cooperating with index slots in turret body 36 and adapted to lock cap 35 in either of two 180° positions against rotation with respect to turret body 36. Turret body 36 is small and, in the example herein illustrated, may have the diameter in the order of about ¾ of an inch. Turret body 36 has a number of brass or copper contact members and contact buttons, to be described later.

Figures 7, 8, 9, 10:
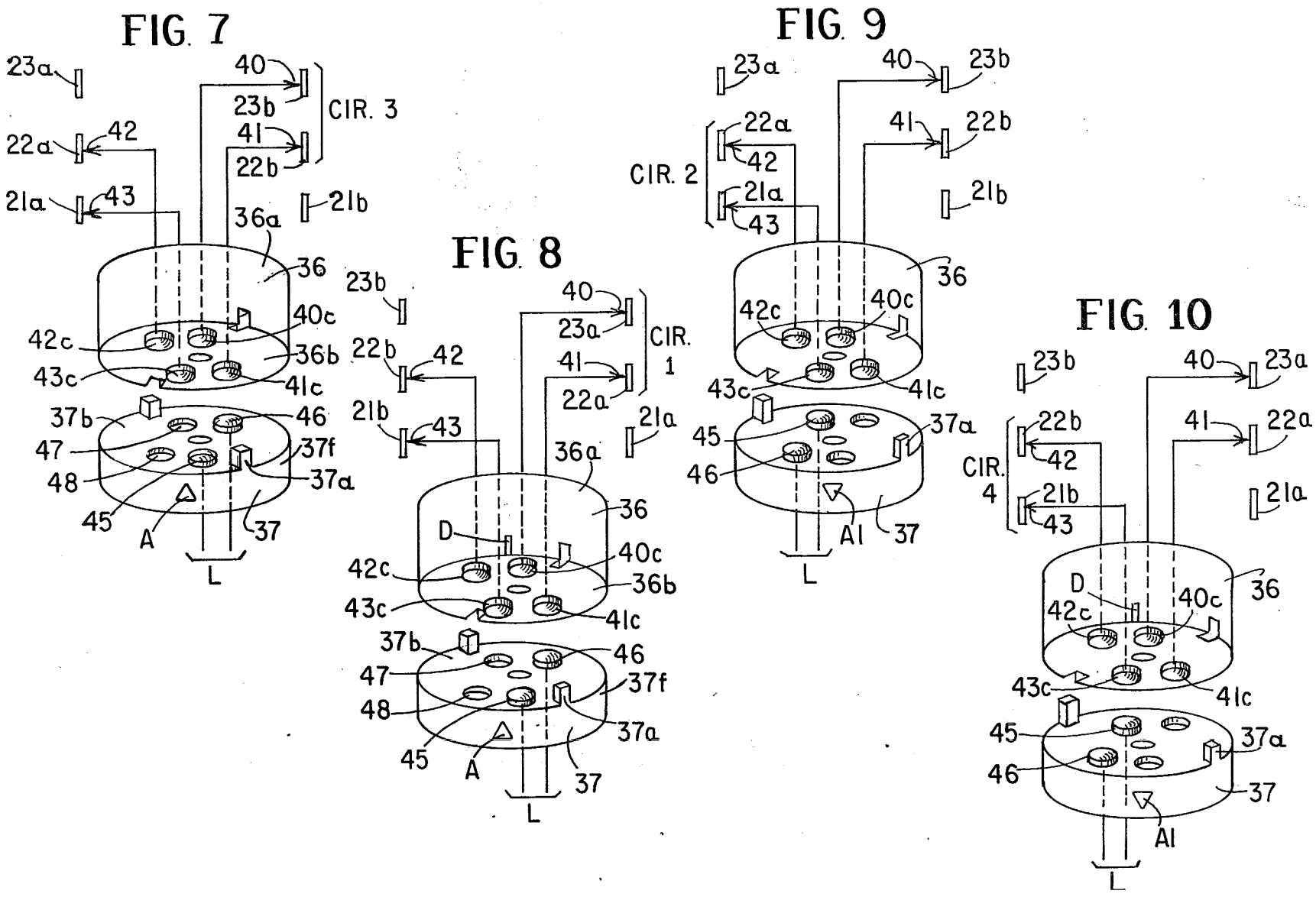
FIGS. 7 to 10, inclusive, are schematics of four possible circuit arrangements of the adapter.

Turret body 36 (FIG. 7) has one end face 36*a* opposite turret cap 35 and has its other end face 36*b* opposite turret base 37. Turret base 37 is provided with diametrically opposed locking fingers 37*a* cooperating with a pair of slots extending into the turret body 36, the arrangement being such that turret body 36 may be disposed in either of two diametrically different index positions. Such two-position selection provides different circuit connections. Turret base 37 is also provided with two laterally extending diametrically opposed track locking wings 37*b*. Turret base 37 extends below wings 37*b* to turret plate 37*c*. This part 37*c* stops turret 37 from going too far into the track.

The dimensions of the turret assembly with relation to the dimensions of the track assembly are such that the turret can be inserted into the track only when wings 37*b* extend longitudinally of the track. After inserting fully into the track, the turret assembly can be turned 90° in either direction, subject to a lock on turret plate 37*c*, so that wings 37*b* wedge against tapered flange portions 10*e* as shown in FIG. 1. In this clamped position of the turret within the track, laterally extending turret contacts engage conductors carried by the liners of the track assembly. As will be observed from FIGS. 1, 2 and 3, two blade contacts 40 and 41 extend radially outwardly from turret body 36 on one side and two blade contacts 42 and 43 extend radially outwardly from the other side of the turret body (the contact pairs being 180° apart) with two blade contacts 40 and 41 of one group being longitudinally offset from the two blade contacts 42 and 43 of the other group.

Figure 2:
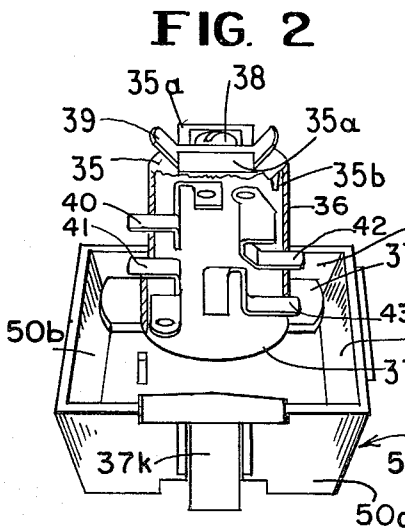
FIG. 2 is a perspective view of the adapter, shown in section in FIG. 1 within the track assembly, and useful for a one circuit power take-off from the circuits available in a track assembly.

The assembly of turret base 37, turret body 36 and turret cap 35 is maintained intact by metal bolt 38 and nut 38*a* carrying grounding spring contact 38*b*. The head of bolt 38 lies between guide portions 35*a* of the turret cap. The nut portion 38*a* presses against the underface of turret plate 37*c*. Bolt 38 and its head supports a spring metal ground contact member 39 having a washer body portion for accommodating the bolt and having lateral extensions bent at an angle as illustrated in FIGS. 1 and 2. The ground contact member is of brass and lies between guide portions 35*a* of the turret cap and is locked against rotation by said guide portions. The lateral extensions of ground contact member 39 are bent at an angle so that when the adapter, as shown in FIG. 1, is installed and locked into the track assembly, ground contact member 39 will press on flat grounding conductor 25.

Contact blades 40 to 43, inclusive, mounted in turret body 36 are wired internally to electrically connect with some contact buttons in face 36*b* of the turret body (FIGS. 7–10). Turret body 36 is preferably of molded insulating material and is provided with internal recesses and passages for accommodating electrical connectors in the form of spring brass strips, examples of which are illustrated in FIG. 1. Referring briefly to FIG. 1, blade 40 is part of a stamped piece of brass 40*a* which appears at the top face of turret 36, as seen in FIG. 1, and which is riveted to elongated rivet 40*b* lying in a passage within turret body 36. The bottom end of rivet 40*b* has head 40*c* at the bottom surface of face 36*b* of the turret body. Blade contact 41 of the turret is part of a brass strip 41*a* suitably shaped and carrying contact button 41*c*. Similarly, contact blades 42 and 43 form part of brass strips suitably shaped and terminating in contact buttons 42*c* and 43*c*. The electrical connections between contact blades 40 to 43, inclusive, may be accomplished in a number of ways.

As indicated in FIGS. 7 to 10, inclusive, different electrical connections with indications thereof are possible with different rotary positions of turret body 36 with respect to turret base 37. The entire adapter can be inserted in either of two positions in the track assembly as previously set forth. This makes it possible to provide a total of four different circuit connections to a load and have indications corresponding thereto. The arrangement of buttons 40*c* to 43*c* on face 36*b* of the turret body is preferably non-symmetrical about the turret axis.

Turret base 37 has a face 37*b* which normally rests against turret body face 36*b*. Face 37*b* of turret base portion 37 has electrical contact buttons 45 and 46, so located as to engage and make electrical contact with either buttons 40*c* and 41*c* in one position of the turret, or connect with the remaining two of the four buttons in turret body 36 when the body is turned 180°. The locating fingers and slots previously described permit such rotational adjustment when the turret body and turret base are separated, as shown in diagram for example, in FIGS. 7 to 10, inclusive, it being understood that bolt 38 and nut 38*a* are loosened to permit such rotary adjustment. Turret base 37 has blind recesses 47 and 48, located to accommodate the unused buttons of turret body 36. These two recesses do not contain any contacts. Live contact buttons 45 and 46 are electrically connected to heavy spring contacts 45*a* and 46*a*, supported in turret base 37.

Turret plate 37*c* has box-like housing 50 having sidewalls 50*a*, 50*b*, 50*c*, 50*d* and bottom wall 50*e*. Box-like housing 50 is securely attached to turret plate 37*c* by bolts 50*f* (FIG. 3) which are threaded into bosses on the inside of the turret plate 37*c*. The two spring contacts 45*a* and 46*a* are within the box-like turret housing portion as shown in FIG. 1.

Contacts 45*a* and 46*a* and ground spring 38*b* can provide electric power to a grounded load from one of four possible live circuits within a track assembly. Means are provided for indicating which of the available circuits within the track assembly have been selected. Thus, turret base 37, turret body 36 and turret cap 35 have flats disposed at diametrically opposed areas (FIG. 3) longitudinally of the turret axis. Turret body 36 has a small linear depression D longitudinally thereof along one of its flats ending at bottom face 36*b*. The turret base portion 37 has a molded arrowhead A pointing up toward turret body 36 on one flat and a molded arrowhead A pointing down away from turret body 36 on the other flat (FIGS. 7 to 10). By loosening bolt 38 enough to permit relative turning of turret body 36 with respect to turret base 37, it is possible to select one of the two positions where the turret body and turret base can lock and thus have the straight mark D on the turret body register with either the turret base up arrowhead A or the down arrowhead Al. In addition, cooperating housing portion 50 at sidewall 50*d* accommodates small screw 50*g* which retains a triangular plate 50*h* to indicate an arrowhead either in the up position or the down position as seen in FIG. 3. In the installed position of the adapter, as seen in FIG. 1 in a track length, the turret structure above plate 37*c* will not be visible from the outside.

Figure 5:
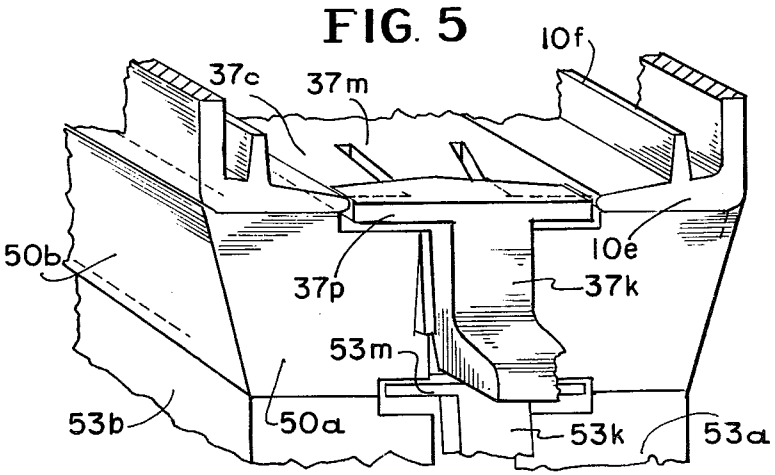
FIGS. 5 and 6 are enlarged perspective details of portions of the adapter.
Figure 6:
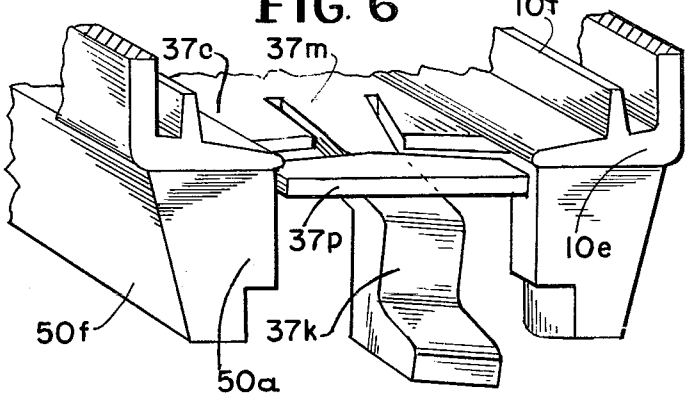
Figure 4:
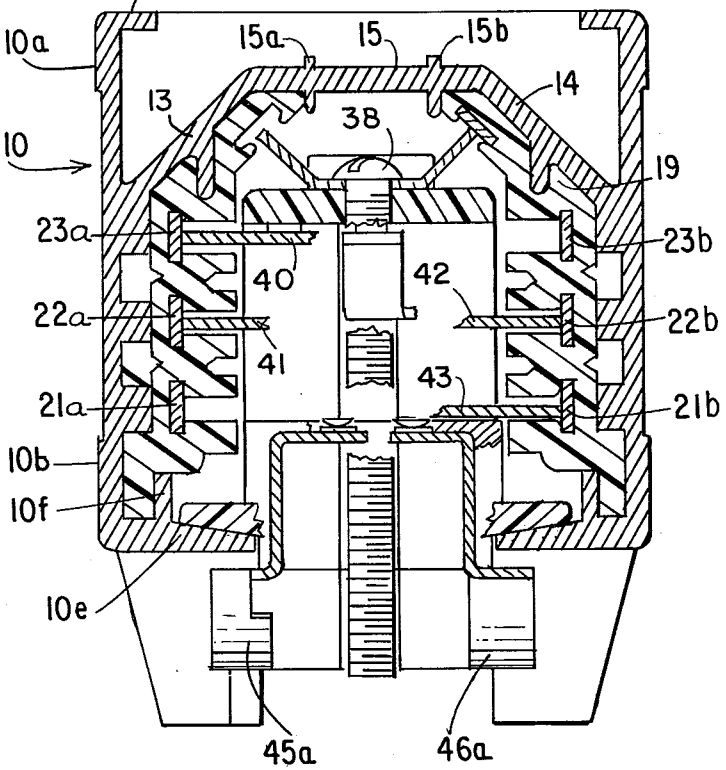
FIG. 4 is a section of a track assembly with the adapter illustrated in FIGS. 1, 2 and 3, in a position different from that illustrated in FIG. 1.

Means are provided for locking the adapter into the track for normal use of the adapter. Accordingly, turret plate 37*c* has a locking member which normally locks the adapter from being turned in the track after the adapter has been properly positioned therein. The locking means is disposed upon that side of turret plate 37*c* which would normally extend across the length of the track in the installed position of the adapter. Referring to FIGS. 5 and 6, turret plate 37*c* includes finger piece 37*k* which extends downwardly from blade 37*m* in plate 37*c*. Blade 37*m* is thin enough to permit finger piece 37*k* to be moved downwardly with respect to plate 37*c* as illustrated in FIG. 6, from a normal position as illustrated in FIG. 5. The plastic blade has natural memory to return to the normal position when free. By properly selecting the material such as polycarbonate (Lexan) and proportioning the thickness and length of blade 37*m*, it is possible to provide such a finger piece as shown, which can be bent to the position shown in FIG. 6, and have this finger piece 37*k* return to its normal position illustrated in FIG. 5, when free to do so.

In the normal position of the finger piece as illustrated in FIG. 5, blade 37*m*, which extends from an inner portion of turret plate 37*c* outwardly and merges into finger piece 37*k*, carries locking strip 37*p*, whose length is transverse of the track opening and a bit shorter than the width of the track opening, extending transversely of the track in the installed position of the adapter. Locking strip 37*p* is normally somewhat above the level of bottom surfaces of track portions 10*e*, in which position locking strip 37*p* prevents rotation of the turret assembly. In order to install a turret assembly into the track or remove the same from the track, it will be necessary to force downwardly as seen in FIGS. 5 and 6, finger piece 37*k* to lower locking strip 37*p* below the track as illustrated in FIG. 6, after which the turret assembly can be turned 90° in either direction.

To draw power to a load from contacts 45*a* and 46*a*, the plug arrangement illustrated in FIG. 3 and shown disconnected from and below the adapter proper, may be used. The plug structure comprises a molded housing 53 and is generally box-shaped and has front wall 53*a*, side wall 53*b*, rear wall not visible and side wall 53*d*. The cover of the plug consists of a top plug plate 53*f* which fits snugly to provide an inset cover for the box-like housing 53 and is locked to said housing and plate by bolts 53*g* (only one appears). Plug plate 53*f* has flexible blade 53*h* extending toward wall 53*a*, the blade normally lying in the plane of 53*f* and carrying locking strip 53*m* and finger piece 53*k* extending down and outwardly from wall 53*a*. In the assembled position of the turret and plug of FIG. 3, finger piece 53*k* is below finger piece 37*k*, while walls 50*a* and 53*a* of the turret assembly and plug assembly are generally aligned with wall 50*a* being above face 53*a*. The plug finger piece normally has locking portion 53*m* above the top edge of plug housing 53 as illustrated in FIG. 3. Downward force on 53*k* can be exerted so that the finger piece is moved down to drop locking portion 53*m* below the level of the top edge of plug housing 53. In the installed position of the plug housing to the bottom of the turret assembly, locking piece 53*m* can extend into cutaway 50*m* to lock 53 against rotation with respect to housing 50 of the turret assembly. In the top position of the plug assembly and the turret assembly, finger pieces 37*k* and 53*k* are aligned, finger piece 53*k* locking the plug assembly to the bottom of the turret housing 50 against relative rotation while finger piece 37*k* locks the turret assembly against rotation with respect to the track assembly.

Plug plate 53*f* carries plug turret 55 of electrically insulating material extending upwardly therefrom as illustrated in FIG. 3. This turret has lateral extensions 55*a* which function in a manner similar to the locking wings 37*b* of the large turret. Extending beyond such lateral extensions are separate contact blades 55*b* and 55*c* electrically insulated from each other and electrically connected to terminals below plug plate 53*f* within housing 53. These two contact blades 55*b* and 55*c* are so oriented and the mounting is so dimensioned and proportioned that in the installed position of the plug within housing 50 of the turret assembly, electrical contact will be made respectively with spring terminals 45*a* and 46*a* of the turret assembly as shown in FIG. 1. A grounding contact blade 55*d* is carried by plug assembly bolt 55*e* holding the blade turret portions together tightly. Plug bolt 55*e* and nut 55*f* maintain the two portions of the plug turret assembly intact.

To assemble or insert the plug assembly illustrated in the lower portion of FIG. 3, into the turret assembly illustrated in the upper portion of FIG. 3, the following procedure is necessary. The plug assembly is oriented so that wall portion 53*a* carrying finger piece 53*k* is in line with wall portion 50*b*. Finger piece 53*k* will be pressed down by the bottom of housing 50 so that locking portion 53*m* is substantially flush with the top edge of housing 53 of the plug and also with plug plate 53*f*. This will orient plug turret 55 so that the wings 55*a* and the contact blades 55*b* and 55*c* can enter opening 50*p*. This last named opening is irregular in shape as illustrated in the top portion of FIG. 3, the length and width of the irregular opening being such that the plug turret 55 can enter through this opening into housing 50 only when the orientation previously described is present.

With the plug turret disposed within housing 50 of the main turret assembly, finger piece 53*k* of the plug assembly will be maintained in the down position by bottom 50*e*. The plug assembly is now rotated through 90° to bring finger piece 53*k* below finger piece 37*k* in substantial alignment. When this occurs, finger piece 53*k* of the plug assembly will automatically assume its normal position as shown in FIG. 3. Locking strip 53*m* enters slot 50*m* in housing 50, whereupon the plug assembly will be locked to the turret assembly.

Upon rotation of the plug assembly through 90°, contact blades 55*b* and 55*c* will engage turret assembly contacts 45*a* and 46*a*. In practice, the general dimensions of the plug assembly with reference to plug plate 53*f* plus the thickness of the edges of housing 53, will generally be substantially equal to the dimensions of bottom wall 50*e*. It is possible to orient the plug assembly 53 housing so that finger piece 53*k* of the plug assembly could be on either side with reference to the turret assembly housing wall 50*a*.

With the plug assembly disposed so that the plug assembly is locked to the turret assembly, the plug assembly is locked against rotation with respect to the turret assembly.

In order to disconnect the plug assembly from the turret assembly, it is necessary to press down finger piece 53*k* of the plug assembly and turn the plug assembly left 90° as seen from the bottom of the plug assembly.

What is claimed is:

1. An adapter for providing electric power to a single circuit load from a multi-circuit distribution system of the type having a U-channel assembly whose opening is narrower than the channel interior, said channel assembly including longitudinal conductors within the channel interior disposed adjacent the channel side walls to provide three opposed conductor pairs at different levels along the channel depth, said adapter comprising a base portion with a turret support portion having a flat mounting face whose dimensions are greater than the width of the channel opening to prevent the flat face entering the channel along a line normal to the channel opening, an insulating turret having a bottom flat face, means adjustably securing said turret support flat face to said insulating turret bottom flat face to permit turret rotary adjustment to one of two positions by a central bolt, the turret lateral dimensions and length permitting insertion of said turret into said channel in either of two positions with said flat mounting face disposed against the channel opening to limit turret insertion, two pairs of electrical contact blades extending laterally from said turret at opposite sides thereof, said contact blades being long enough to prevent turret insertion except when said blades extend along the channel length and after insertion and 90° rotation of said adapter, said contact blades bear against certain conductors corresponding to the blade locations along the turret length, one turret contact blade at one turret side being offset longitudinally of the turret from one turret contact blade at the other turret side so that the connecting pattern can be changed with turret orientation, means for locking the adapter, after insertion into the channel and 90° rotation thereof, against removal from the channel, two output terminals for connection to a load, said output terminals being supported on said base portion and being always available for connection to a load, said turret resting upon said turret support portion flat face, the turret and turret support faces carrying cooperating electrical contacts, the contacts on said turret support face being two in number and being connected to said output terminals, the cooperating contacts of said turret face being four and being respectively connected to said four turret contact blades, said adjustable turret securing means providing for two possible turret orientations 180° apart about the turret axis, whereby a greater selection of power supply circuits for connection to the load circuit is possible.

2. The construction according to claim 1, wherein said bolt is electrically conducting, said bolt supporting at least one ground contact blade at the free end of said turret, said contact blade being adapted to engage a grounding conductor within said channel only when said adapter is inserted into a locked position within said channel, said conducting bolt extending through said turret and base portion and having metal nut means for use in tightening the bolt, said metal nut means being symmetrically disposed between said two output terminals and being adapted for use as a grounding connection between said two output terminals.

3. The construction according to claim 1, wherein a plug for connecting a load circuit to said adapter is provided, said plug having wiping contacts for cooperating with the output terminals of said adapter, said plug wiper terminals and adapter output terminals cooperating to make or break connections between the respective terminals of plug and adapter upon moving said plug against said adapter and turning with respect thereto, said plug having a flexible blade carrying a locking strip and finger piece, said plug locking strip in normal position extending into a slot into said adapter when the two are fully connected and locked together against relative rotation, said plug being selectively removable from said adapter and said adapter being selectively removable from said channel of said track either together or individually upon operation of their respective locking means.

4. The construction according to claim 3, wherein said plug carries a small turret having said wiping contacts, said small turret of said plug being adapted to be inserted into said adapter for connection to the output terminals of said adapter.

5. The construction according to claim 4, wherein indicating means are provided on the adapter turret and turret base for indicating which of the adapter turret contacts are live with respect to the adapter output terminals and wherein an indicating member is disposed upon the outside of the adapter to indicate live adapter contacts, said last named indicator means being visible when said adapter is connected into said track.

* * * * *